US005127231A

United States Patent [19]

Larue et al.

[11] Patent Number: 5,127,231

[45] Date of Patent: Jul. 7, 1992

[54] PROCESS AND APPARATUS FOR TRANSPORTING AND TREATING A NATURAL GAS

[75] Inventors: Joseph Larue, Chambourcy; Jean Claude Collin, Vernouillet; Ari Minkkinen, Saint Nom la Breteche; Alexandre Rojey, Rueil Malmaison, all of France

[73] Assignee: Institut Francais du Petrole, Rueil-Malmaison, France

[21] Appl. No.: 643,620

[22] Filed: Jan. 22, 1991

[30] Foreign Application Priority Data

Jan. 23, 1990 [FR] France ..... 90 00757

[51] Int. Cl.[5] ..... F25J 3/00

[52] U.S. Cl. ..... 62/20; 55/68

[58] Field of Search ..... 62/17, 20; 55/68

[56] References Cited

U.S. PATENT DOCUMENTS 3,262,278 7/1966 Thorsten et al. ..... 62/20
3,330,124 7/1967 Marshall ..... 62/20
3,899,312 8/1975 Kruis et al. ..... 62/20
3,925,047 12/1975 Harper ..... 62/20

*Primary Examiner*—Ronald C. Capossela
*Attorney, Agent, or Firm*—Millen, White & Zelano

[57] ABSTRACT

Described are a process and an apparatus for transporting and treating a natural gas.

The process according to the invention comprises contacting in a zone $G_1$ the gas issuing from a production well (1) with a liquid phase coming at least in part from recycling (4) and containing water and at least one anti-corrosion additive and/or at least one anti-hydrate additive which is at least partly water-miscible and vaporizing in the pure state or in azeotrope form; transporting the additive-charge gaseous phase in a conduit (5), cooling it at $E_1$, separating at $B_1$ an aqueous phase from the non-condensed gas which is collected by way of a conduit (10) and recycling the additive-charged aqueous phase to the contact zone $G_1$ by way of the line (9, 4).

The process and apparatus are for the transportation of natural gas over long distances in particular.

21 Claims, 2 Drawing Sheets

PROCESS AND APPARATUS FOR TRANSPORTING AND TREATING A NATURAL GAS

Figure 1:
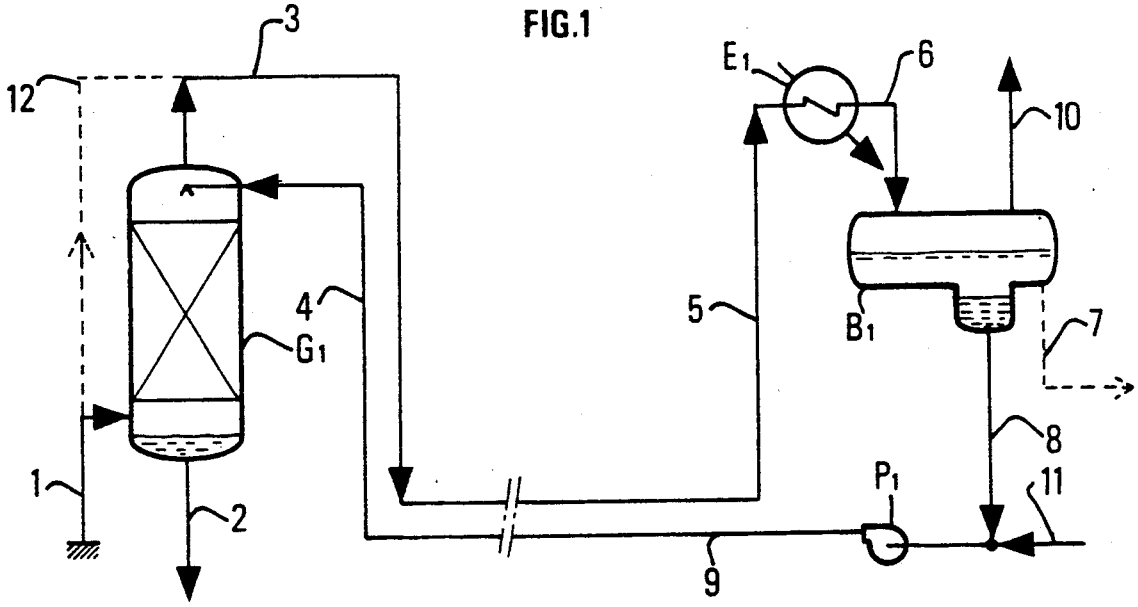

The present invention concerns a process and an apparatus for using and regenerating addditives for inhibiting corrosion and/or hydrates for the transportation and treatment of a natural gas.

In situation involving the production of natural gas in a difficult area, that is to say off-shore or on land in areas which are remote or generally inaccessible, the production companies seek to send the gas which may be produced at different wells and collected to a central site for treatment and conditioning after a minimum numer of transformation operations and/or prior treatment, so as to minimize the capital investment and operating costs; the amounts to reducing the opeations carried out on the production site to that which is strctly necessary in order that transportation of the gas by way of a gas pipeline to the treatment site can be effected without mishap; in fact, some components of natural gas, namely water and acid gases ($C0_2$, $H_2S$) require particular precautions to be taken.

Water being present in the deposit, natural gas is saturated with water at the temperature of production; in the course of transportation the gas generally experiences a drop in temperature which causes condensation of a part of the ater but which under certain conditions can also give rise to the formation of crystals. These crystal are formed of hydrates which are compounds of inclusion of molecules of hydrocarbons in crystalling structures, formed by the molecules of hydrocarbons in crystatlling structures , formed by the molecules of water and which form at a temperature which is markedly highly than 0° C. The formation of hydrates in a gas pipeline can result in blockage and can cause production to come to a halt. To avoid that, it is necessary either to dehydrate the gas prior to transportation thereof or to inject into the gas a hydrate inhibitor such as methanol or ethylene glycol. In the former case the gas is generally treated in a washing unit by means of glycol to adjust the water dew point to the value required for transportation, the latter operation beng effected under monophase conditons; in the second case, the inhibitor is introduced into the gas just after the well head and transportation is effected at leaast partially under diphasic conditions.

Most natural gases contain a more or less substantial proportion of acid gases, that is to say $C1_2$ and/or $H_2S$. Those comppunds cannot generally be separated on the production site and have to be transported with the gas. Acid gases give rise to corrosion phenomena in the conduits, particularly in the presence of water. It is therefore necessary for corrosion inhibitors to be injected into the gas as from the well head itself in order to protect the conduits, as corrosion can eventually cause ruptures in lines or serious gas leakages. The corrosion inhibitors are injected in amounts but as they are generally difficult products, they contribute to an increase in the gas production cost.

When it reaches the treatment site, the gas which may come from a number of different wells feeding a single gas pipeline is generally dehydrated to obtain a lower water dew point than which is required for transportation purposes; the second dehydration step can be carried out in most cases either by means of absorption of the water in glycol or by means of adsorption of the water on molecular sieves; the dehydration process which is carried out in that way can be different from that which is used at the production site to provide the water dew point required for transportation of the gas. The second dehydration step is essential if there is a wich to be able to cool the gas to a relatively low temperature whichmay be for example between −10−40° C. in order to extract therefrom the natural gas liquids, that is to say hydrocarbons other than methane which can be delivered as liquid at ambient temperature. Under those conditions the additives which have been injected for transportation purposes (hydrate-formation inhibitors and corrosion inhibitors) are absorbed in the course of the treatment and are not recycled.

It has been discovered that certain additives (hydrate-formation inhibitors or corrosion inhibitors) can be recovered and recycled to the production well head, which makes it possible to very substantially reduce the level of consumption thereof and to reduce the gas production costs.

It was also discovered that, when carrying out the treatment 20 which is performed on the gas at the terminal after transportation thereof, such additives also play a positive part, which avoids the use of other additives.

The process according to the invention corresponds to a novel use of those anti-hydrate and/or anti-corrosion additives, which permits recycling thereof.

In general, the process comprises the following steps:

a) At least a part of said gas issuing from at least one production well is contacted under suitable contacting conditions in at least one contact zone with a liquid phase coming at least in part from recycling (step e) hereinafter) and containing both water and at least one anti-hydrate additive, said additive being a non-hydrocarbon compound which is normally liquid, other than water, said compound being at least partially water-miscible and a vaporizing in the pure state or in azeotrope from at a temperature lower than the temperature of vaporization of the water, so as to obtain an aqueuos liquid phase with a reduced additive content by comparison with said recycled liguid phase and an additive-charged gaseous phase;

b) Transporting said additive-charged gaseous phase in a conduit to at least one heat exchange zone;

c) Cooling under adequate conditions said gaseous phase coming from stepb) in the heat exchange zone so as partially to condense it and to obtain a non-condensed gas, the condensate obtained comprising at least one aqueous phase, which contains at least a part of said additive;

d) Separating the aqueous phase from the non-condensed gas under suitable conditions in a separation zone and taking off said non-condensed gas; and e) Recycling the aqueous phase to step a) by transporting it in another conduit to the contact zone.

The term compound "which is normally liquid" means liquid under normal conditions with respect to temperature and pressure.

The proportion by weight of anti-hydrate solvent in the water is generally from 10 to 70% and preferably from 20 to 50%.

In accordance with another embodiment of the invention, with the anti-hydrate additive and the water, it is possible to introduce at least one anti-corrosion additive which is non-hydrocarbon and which is at least partially miscible with water or dispersable in water and which vaporizes preferably at a boiling temperature lower than that of water or forming with water an azeotrope whose boiling temperature is lower than that of water, so as to be capable of being entrained by the gas in the course of step a) of the process.

In that mode of operation, the proportions by weight in the acqueous liquid mixture are usually as follows:

from 0.1 to 5% and preferably from 0.3 to 1% of anticorrosion additive.

from 10 to 70% and preferably from 20 to 50% of antihydrate additive, and from 29.9 to 89.9% and preferably from 49.7 to 79.7% of water.

The proportion of aqueous liquid phase introduced into the contact zone corresponds as a general rule to from 0.05 to 5% by weight of the flow rate by mass of gas to be treated and advantageously from 0.1 to 1%, the contacting step generally being carried out at a temperature and a pressure substantially corresponding to that of the gases issuing from the production well, for example approximately 20 to 100° C. under a pressure of from 0.1 to 25 MPa.

The invention also concerns the apparatus used for transporting and treating a natural gas. As a general rule it comprises the following means which co-operate with each other:

at least one enclosure (G1) for contacting under pressure and preferably in counter-flow relationship a gas with at least one additive, having a first end and a second end advantageously disposed below the firt end, means (1) for the introduction of said gas, which are connected to transportation means (3,5) and/or to the second end of the enclosure, means (4) for the introduction of an aqueous liquid phase comprising at least one additive, connected to means for recycling of said liquid phase and to the first end of said enclosure, means (2) for the discharge of a liquid aqueous phase, connected to the second end of the enclosure.

means (3, 5) for transportation of a gaseous phase under pressure, connected to the first end of the enclosure (G1) and to means ($E_1$) for heat exchange under pressure, means ($B_1$) for separation of a liquid aqueous phase from the non-condensed treated gas, which are connected to the heat exchange means, means (10) for recovery of the non-condensed and treated gas, which are connected to the separation means($B_1$), means (8) for taking off the aqueous phase, which are connected to the separation means; and means ($P_1$, 9, 4) for recycling of the aqueous phase, which are connected to the means for taking off the aqueous phase, comprising a conduit connected to the first end of the enclosure (G1).

Figure 2:
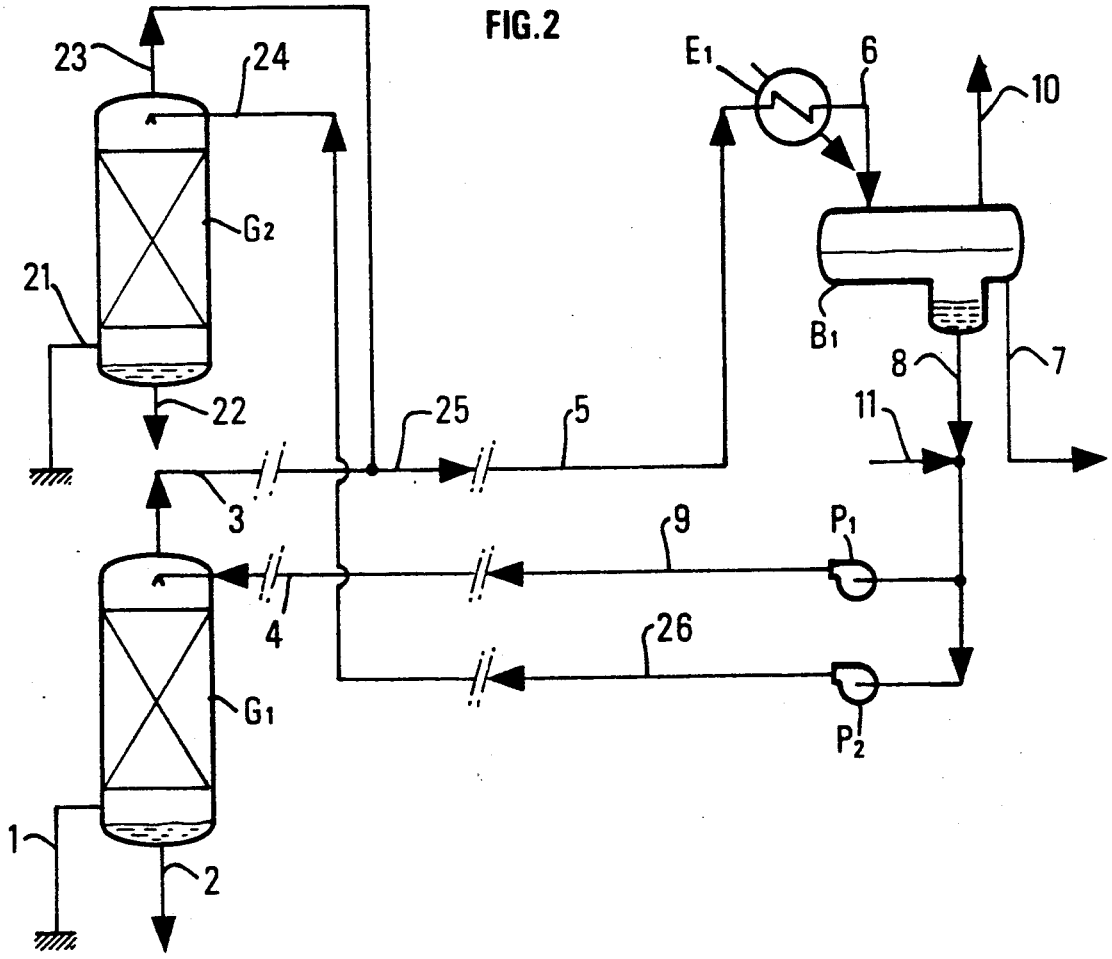
Figure 2A:
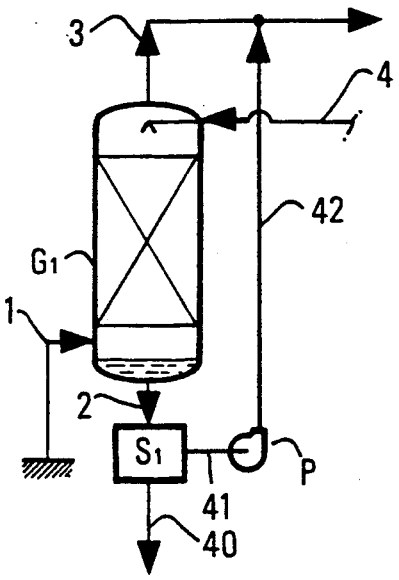
Figure 3:
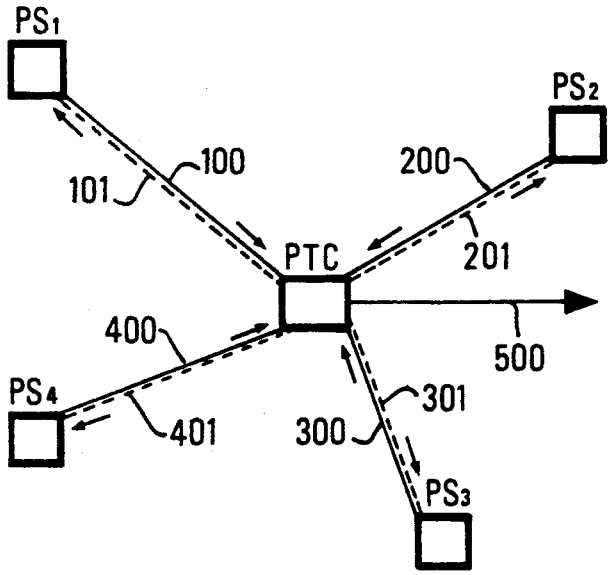
Figure 4:
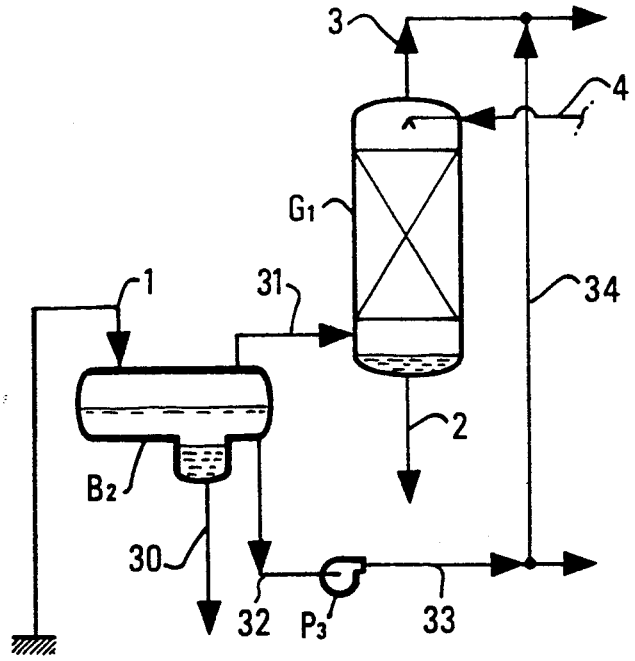
Figure 5:
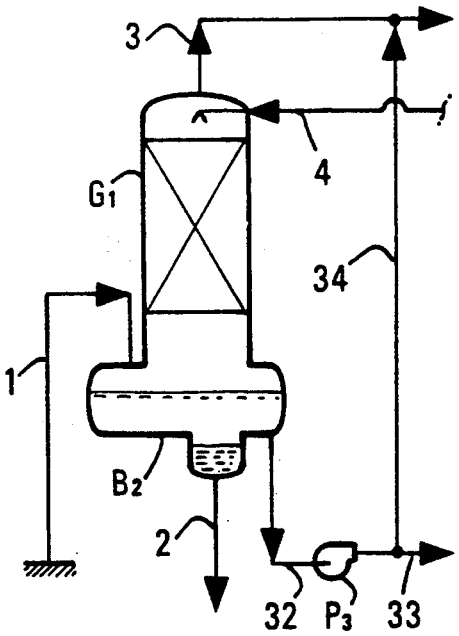

The invention will be better appreciated by reference to the accompanying Figures which illustrate diagrammatically and without limitation particular embodiments of the process, in which :

FIG. 1 shows the apparatus according to the invention,

FIG. 2 illustrates the presence of a plurality of zones for contact with the additives of the invention, FIG. 2A shows another embodiment with particular anti-corrosion additives, FIG. 3 is a diagrammatic view of a production system operating with four wells and a central treatment platform, FIG. 4 shows pre-treatment of gas with condensates, and FIG. 5 shows an alternative form of pre-treatment of said gases with condensates.

The principle of the process according to the invention is illustrated by the diagrammatic view in FIG. 1, applied by way of example to a natural gas containing methane, associated higher hydrocarbons, acid gases (carbon dioxide and hydrogen solphide) and which is saturated with water under the conditions in respect of temperature and pressure of production.

The natural gas issuing from the production well head arrives by way of the conduit 1 at the bottom of a contacting enclosure G1 which is preferably substantially vertical. In the contact zone G1 which preferably operates in counter-flow relationship, the natural gas is brought into contact with a mixture formed by water, at least one hydrate-inhibitor solvent along or in mixture with at least one corrosion-inhibiting additive coming from the conduit 4. A gaseous phase which is charged with solvent and additive is removed at the top, by way of the conduit 3. At the bottom, an aqueous phase from which solvent and additive have been substantially removed is taken off by way of the conduit 2. The top gaseous phase is transported in the conduit 3 over a distance which may be several kilometres and by way of the conduit 5 goes to the reception terminal where the gas can be treated before being pased into the commercial system. The gas flowing in the conduit 5 is cooled to the low temperature required for treatment in the heat exchanger E1 by a refrigerating fluid which is external to the process, that causing partial condensation: that cooling effect does not give rise to any hydrate formation phenomenon by virtue of the presence of the inhibitor solvent in the gas in a sufficiently large amount. The cooled mixture issuing from the exchanger E1 by way of the conduit 6 is formed of a condensate comprising an aqueous liquid phase which contains the major part of the water, solvent and additive which were to be found in the gas issuing from the contact zone G1 by way of the conduit 3, and a gaseous phase which is referred to as a weak gaseous phase, with a reduced content of heavy hydrocarbons. Those two phases are separated in the settlement vessel B1; the weak gas from which the major part of the water and the heavy hydrocarbons that it contained on passing into the process in the conduit 1 has been removed is taken off by way of the conduit 10; the acqueos liquid phase is taken off by way of the conduit 8, possibly with the addition of a make-up amount of solvent and additive flowing in the conduit 11 in order to compensate for the losses, picked up by the pump P1 again and passed by way of the conduit 9 back to the production site where it arrives by way of the conduit 4 to be recycled.

If the proportion of hydrocarbons which are heavier than methane is relatively substantial, in the course of cooling, a liquid hydrocarbon phase is formed. In the situaton illustrated in FIG. 1, that liquid hydrocarbon phase is separated from the acqeous phase in the vessel B1 and discharged by way of the conduit 7.

Throughout the process described, the hydrate-formation and corrosion phenomena do not occur because they are inhibited by the presence of the anti-hydrate solvent and the anti-corrosion additive which protect the whole of the installation. One of the advantages of the process according to the invention is that the anti-hydrate and anti-corrosion additives which are used are effective over the whole of the installation, that is to say the contact zone G1 where contact occurs between the gas and the additives at the production site, the transportation conduit which permits the gas to be passsed from the production zone to the reception terminal and the treatment zone in the course of which the natural gas is separated from the water and the heaviest hydrocarbons.

When a liquid hydrocarbon phase is formed in the course of the cooling step (c), it is separated from the aqueous phase by a settlement procedure and discharged.

Because there is no need to use all the gas in the contact zone G1 in order to cause the anti-hydrate and-/or anit-corrosion additives aariving by way of the conduit to pass into the vapor phase, and as indicated in broken line in FIG. 1, a part of the gas to be transported (coduit 12) may be directly mixed with the gas issuing from the contact zone G1 by way of the conduit 3, without having to pass through the contact zone G1. In addition the natural gas is generally produced by a plurality of wells. In that case it is possible to bring together the effluents from a number of different wells in a single process according to the invention; for that purpose the gas coming from certain wells may be introduced into the process according to the invention by way of the conduit 1 while the gas coming from the other wells can be introduced into the process by way of the conduit 12.

In the event that natural gas is produced by a plurality of wells which are at distances from each other, a plurality of contact zones G1 may be installed, each being for treating the production of one or more wells, and the whole of the production can be passed by way of a suitable system of conduits to a reception terminal which will treat the whole of the gas production; in that case the recycled aqueous liquid phase which is taken off by way of the coduit 8 is then redistributed to the different contact zones G1; that alternative form of the process according to the invention is illustrated in FIG. 2 in which the items of equipment which are the same as those shown in FIG. 1 are identified by the same references.

In this example, the natural gas is produced by two main sites and it is assumed to contain methane and associated higher hydrocarbons and to be saturated with water under the conditions in respect of temperature and pressure of the production. At the first site, the natural gas issuing from a production well head is treated as described hereinbefore with reference to FIG. 1. At the second site, the natural gas issuing from another production well head arrives by way of the conduit 21. In the contact zone G2, it is brought into contact with a mixture formed of water and hydrate-inhibiting solvent coming from the coduit 24. A solvent-charged gaseous phase is discharged at the top by way of the conduit 23. Ar the bottom, an aqueous phase which is substantially freed of solvent is taken off by way of the conduit 22. The top gaseous phase is transported in the conduit 23 and mixed in the conduit 25 with the gas coming from the first production site, which flows in the conduit 3. All of the gas is transported over a distance which may be several kilometers and it arrives by way of the conduit 5 at the reception terminal where the gas can be treated before being passed into the commercial system. The gas flowing in the conduit 5 is cooled to the low temperature required for treatment in the heat exchanger E1 by a refrigerating fluid which is external to the process, which causes partial condensation; that coolinh effect does not give rise to a hydrate-formation phenomenon due to the presence of the inhibitor solvent in the gas in a sufficiently substantial amount. The cooled mixture issuing from the exchanger E1 by way of the conduit 6 is formed by an aqueous liquid phase which contains the major part of the water and solvent which were to be found on the one hand in the gas issuing from the contact zone G1 by way of the conduit 3 and on the other hand in the gas issuing from the contact zone G2 by way of the conduit 23, a liquid hydrocarbon phase formed by the heaviest hydrocarbons of the gas and a gaseous phase which is referred to as the weak gaseous phase, with a reduced content of heavy hydrocarbons. Those three phases are separated in the settlement vessel B1; the weak gas from which the major part of the water and heavy hydrocarbons which it contained on passing into the process in the conduit 1 and 21 has been removed is taken off by way of the conduit 10; the liquid hydrocarbon phase is taken off by way of the conduit 7; and the aqueous liquid phase is taken off by way of the conduit 8, a make-up amount of solvent flowing in the conduit 11 is added thereto to compensate for the losses and it is picked up on the one hand by the pump P1 again and passed by way of the conduit 9 to the first production site where it arrives by way of the conduit 4 for recycling, while on the other hand it is also picked up by means of the pump P2 and passed by way of the conduit 26 to the second production site which it reaches by way of the conduit 24 for recycling thereof.

FIG. 3 shows an example of a production system operating with four wells which are disposed at distances from each other, as indicated PS1, PS2, PS3 and PS4 repsectively. The gas is carried to a central treatment platform PTC from the well PS1 by of the conduit 100, from the well PS2 by way of the conduit 200, from the well PS3 by way of the conduit 300 and from the well PS4 by way of the conduit 400. On the central treatment platform PTC the gas is cooled so as to produce an aqueous phase and a partially dehydrated gas, the water dew point of which complies with the transporation specification which requires it to be of a value for example of less than or equal to $-10°$ C. The gas obtained in that way is compressed by a compressor disposed on the platform PTC and discharged by way of the conduit 500.

The gaseous phase is passed to the production wells PS1, PS2, PS3 and PS4 again by means of pumps which pass by way of the conduits 101, 201, 301 and 401 flow rates of aqueous phase which are proportional to the flow rates of gas carried by the conduits 100, 200, 300 and 400. At the location of each production well there is a contacting device which permits charging with additive of the gas produced and discharge of an aqueous phase which has been substantially freed of the additive which it contained at the outset.

On the platform PTC a reserve of additive which is periodically renewed makes it possible to compensate for additive losses by a regular make-up operation.

In many cases the natrual gas is produced accompanied by condensates of hydrocarbons, that is to say the effluent issuing from the well is formed by a gaseous phase and a fraction of liquids composed of the heaviest hydrocarbons; in most cases an aqueous liquid phase is also present at the well outlet. In the case of production of gases with condensates, the system of the process according to the invention, as regards the part disposed on the production site, may be slightly different in order to take the liquid hydrocarbon phase into account; that alrernative configuration is illustrated in FIG. 4: the gas with condensates issuing from the production well head arrives by means of the conduit 1 and passes into the upper part of a separator vessel B2 in which the three phases involved are separated: the aqueous phase formed by water from the deposit is taken off by way of the conduit; the liquid hydrocarbon phase is taken off by way of the coudit 32, picked up by the pump P3 and discharged by way of the conduit 33; and the gaseous phase is taken off by way of the conduit 31 and brought into contact in the contact zone G1 with a mixture formed by water, solvent and additives, coming from the conduit 4. A gaseous phase which is charged with solvent and additives is discharged at the top, by way of the conduit 3. At the bottom, an aqueous phase from which solvent and additives have been substantially removed is taken off by way of the conduit 2. The top gaseous is transported to the reception terminal by way of the conduit 3. The condensates which flow in the conduit 33 may be transported by means of an independent conduit to a reception terminal or mixed by means of a line 34 with the gas flowing in the conduit 3, in which case transporation to the reception terminal under those conditions is effected in a diphasic mode, or in part transported to the terminal and in part mixed with the conduit 3.

An alternative form of the situation involving the production of gas with condensates is illustrates in FIG. 5: in that situation, the separator vessel B2 and the contact zone G1 are integrated into a single item of equipment in order to make gains in terms of compactness, a criterion which is a particularly attractive one in the case of off-shore production. The gas with condensates issuing from the production well head arrives by way of the conduit 1 and passes into the separator vessel B2 in which separation occurs in respect of the liquid hydrocarbon phase, an aqueous phase formed by water from the deposit and water coming from the contact zone G1 in direct relation wit hthe upper part of the separator B2, and a gaseous phase which is brought into contact in counter-flow relationship in the contact zone G1 with a mixuture formed by water, solvent and additives and coming from the conduit 4. A gaseous phase charged with solvent and additives is discharged at the top, by way of the conduit 3, and transported to the reception terminal. At the bottom the aqueous phase from which solvent and additives have been substantially removed is mixed with the aqueous phase comprising water from the deposit, subject to settlement and taken off by way of the conduit 2. The liquid hydrocarbon phase is taken from the vessel B2 by way of the conduit 32, picked up by the pump P3 and discharged by way of the conduit 33; that phase may either be transported to a reception terminal by way of an independent conduit or mixed with the gas flowing in the conduit 3, in which case transporation under those conditions occurs in a diphasic mode.

That alternative makes it possible to arrange from the filling G1 to perform a dual function: on the one hand it makes it possible to provide for contact between the aqueous phase arriving by way of the conduit 4 and the gas arriving by way of the conduit 1; while on the other hand it makes it possible to stop the liquid droplets which are entrained by the gas and thus improve separation between phases.

The installation diagrammatically shown in FIG. 5 can be used on land, on an off-shore platform or under the sea.

In the case of an underwater installation, different configurations may be envisaged. If the gas does not contain any hydrocarbon condensate at the discharge from the well, the water which is discharged by way of the conduit 2 can be passed directly into the sea provided that it has been sufficiently purified in respect of additive in the contact column G1. The gas is then transported by way of an underwater conduit under single-phase conditions.

If the gas contains a hydrocarbon condensate at the outlet from the well, after separation, that condensate is preferably re-mixed with the gas so as to provide for simultaneous transportation under diphasic conditions, which makes it possible for the two phases to be transported in a single conduit. It may be necessary to raise the level of pressure prior to transportation, and that may be effected either after mixing by means of a pump or a dual-phase compressor or after mixing by passing the gas into a compressor and the condensate into a pump.

The anti-hydrate solvent may advantageously be for example methanol. It may also be selected for example from the following solvents: methylpropylether, ethylpropylether, dipropylether, methyltertiobutylether, dimethoxymethane, dimethoxyethane, ethanol, methoxyethanol and propanol, which are used alone or in the form of a mixture.

The anti-corrosion additive may preferably be selected from organic compounds from the chemical family of amines such as diethylamine, propylamine, butylamine, triethylamine, dipropylamine, ethylpropylamine, ethanolamine, cyclohexylamine, pyrridic morpholine and ethylenediamine, which are used alone or in the form of a mixture.

In the situation in which the corrosion-inhibiting additive is dispersable in water and if its boiling temperature is higher than that of water, the additive may be recovered and recycled as shown by the configuration illustrated in FIG. 2A: in accordance therewith, the natural gas issuing from the production well head arrives by way of the conduit 1. It is brought into contact in the contact zone G1 with a mixture formed by water, hydrate-inhibiting solvent and corrosion-inhibiting additive, coming from the conduit 4. An aqueous phase which is essentially charged with solvent is discharged at the top, by way of the conduit 3. The aqueous phase from which solvent has been substantially removed but which still contains the majority of the corrosion-inhibiting additive which has not been entrained by the gas issues from the contact zone G1 by way of the conduit 2 and passes into the separator S1 in which the water is separated from the corrosion-inhibiting additive; the water from which corrosion-inhibiting additive and solvent have been practically totally removed issues from S1 by way the conduit 40; the corrosion-inhibiting additives issues from S1 by way of the conduit 41, and is picked up by the pump P4 and passed by way of the conduit 42 into the conduit 3 in order to be re-mixed with the gas coming from the contact zone G1 and flowing in the conduit 3 to inhibit corrosion during transportation of the gas to the treatment terminal. The separator S1 may be of different types such as for example a coalescing device, a settlement unit, an extractor unit, a distillation unit or a centrifuging unit.

At the treatment terminal the refrigeration temperature required for extraction of the heaviest hydrocarbons from the gas depends on the pressure of the gas and the desired degree of recovery; it may be for example between +10 and −60° C. and preferably between −10 and −40° C. for a gas pressure of for example between 0.1 and 25 MPa and preferably between 0.2 and 10 MPa. The refrigeration effect may be produced either by an external refrigeration cycle or by other means such as for example the expansion of gas in a turbine or an expansion valve.

The dehydrated gas issuing from the cooling step (c) may be subjected to an additional treatment. It may be necessary in particular to remove at least in part the acid gases which it contains. In that case, it is advantageous to use the same solvent as that which is used to inhibit the formation of hydrates, for example methanol, at low temperature, by effecting washing of the gas in counter-flow relationship in a filled or plate-type column. The solvent issuing from the washing zone may then be regenerated by a reduction in pressure and/or heating and recycled. The gas which has been dehydrated and deacidified at least in part is taken off.

Different items of equipment which are known to the man skilled in the art may be used to carry out the different steps in the process.

In particular the contact zone used in the course of step (a) may be provided by means of a plate-type column or a filled column. Different fillings may by used, in particular fillings which are referred to as "structured" and which are disposed in a regular fashion in the contact zone. It is also possible to use fillings formed by metal gauzes which are assembled in the form of cylindrical plugs of a diameter equal to the inside diameter of the contact column.

Any other arrangement known to those skilled in the art which makes it possible to provide for such contact between the liquid phase and the gaseous phase may also be used. Such an arrangement may comprise for example a centrifugal contacting apparatus in which the flow of the two phases in counter-flow relationship occurs not under the effect of gravity but under the effect of a centrifugal force, in order to provide a contacting apparatus of small volume.

The process according to the invention can be illustrated by the following example:

EXAMPLE 1

In this example, the operating procedure is in accordance with the configuration shown in FIG. 1. A natural gas is produced on a site and passes into the process according to the invention by way of the conduit 1. Its pressure is 7.5 MPa (absolute) and its temperature is 40° C.; its composition is set forth in Table 1 and it is saturated in respect of water. Its flow rate is 123 tons/hour, which corresponds to 3.5 $MNm^3$/day.

TABLE 1

| Constituent | % by weight |
|---|---|
| $CO_2$ | 5.1 |
| Methane | 76.2 |
| Ethane | 8.2 |
| Propane | 5.6 |
| Isobutane | 1.1 |
| N-butane | 2.1 |
| Isopentane | 0.6 |
| N-pentane | 0.6 |
| $C_6$+ | 0.5 |

Composition of the gas on entering the process

In the contact zone G1, it is brought into contact with 245 kg/hour of a mixture formed by water, 49.2% by weight of methanol as a hydrate-inhibiting solvent and 0.5% by weight of triethylamine as a corrosion-inhibiting additive coming from the conduit 4. A gaseous phase charged with methanol and triethylamine is discharged at the top by way of the conduit 3. At the bottom, an aqueous phase is drawn off by way of the conduit 2 at a flow rate of 121 kg/hour, containing less than 0.1% by weight of methanol and an undetectable amount of triethylamine. The top gaseous phase is transported in a conduit 3 which is an underwater gas pipeline of a diameter of 0.25 m over a distance of 11.2 kilometres and arrives by way of the conduit 5 at the reception terminal where its pressure is 6.95 MPa by virtue of the pressure drop in the gas pipeline. The gas is cooled to a temperature of −15° C. in the heat exchanger El by a refrigerating fluid which is external to the process; that cooling effect causes partial condensation of the gas. The cooled mixture issuing from the heat exchanger El by way of the conduit 6 is formed by the non-condensed gas and on the one hand 226 kg/hour of an aqueous liquid phase comprising a mixture of water, methanol and triethylamine, and on the other hand 410 kg/hour of a liquid hydrocarbon phase. Those three phases are separated in the settlement vessel B1 at a pressure substantially equal to the pressure at which the gas is received at the terminal; the non-condensed gas is taken off by way of the conduit 10; the liquid hydrocarbon phase is taken off by way of the conduit 8, a make-up liquid flowing in the conduit 11 and formed by 19 kg/hour of methanol and 0.02 kg/hour of triethylamine is added to the liquid hydrocarbon phase, the liquid hydrocarbon phase is picked up by the pump P1 and passed under a pressure of 8.0 MPa by way of the conduit 9 disposed along the underwater gas pipeline to the production site at which it arrives by way of the conduit 4, to be recycled.

We claim:

1. A process for treating and transporting a natural gas issuing from at least one production well to a reception and treatment terminal conprising the following steps:

a) at least a part of said gas at least saturated with water issuing from said production well is contacted under suitable contacting conditions in at least one contact zone with a liquid phase coming at least in part from recycling and containing both water and at least one anti-hydrate additive, said additive being a non-hydrocarbon compound which is normally liquid, other than water, said compound being at least partially water-miscible and vaporizing in the pure state or in azeotropic form at a temperature lower than the temperature of vaporization of the water, so as to obtain an aqueous liquid phase containing substantially no additive by comparison with said recycled liquid phase and a gaseous phase containing water vapor and substantially all the additive' b) transporting said gaseous phase from step (a) under suitable transport conditions in a conduit to at least one heat exchange zone of said terminal;

c) cooling under adequate conditions said gaseous phase coming from step b) in the heat exchange zone so as partially to condense it and to obtain a non-condensed gas, the condensate obtained comprising at least one aqueous phase, which contains at least a part of said additive;

d) separating the aqueous phase from the non-condensed gas under suitable conditions in a separation zone and taking off said non-condensed gas; and e) recycling the aqueous phase from step (d) to step a) by transporting it under suitable pressure conditions in another conduit to the contact zone.

2. A process according to claim 1 wherein the proportion by weight of anti-hydrate additive in the recycled liquid phase is form 10 to 70%.

3. A process according to claim 1 wherein said gas is brought into contact with the recycled liquid phase further containing at least one anti-corrosion additive which is a normally liquid non-hydrocarbon compound other than water, said compound being at least partially miscible with water or dispersable in water and vaporising in the pure state or in azeotrope form at a temperature lower than the temperature of vaporisation of water.

4. A process according to claim 1 wherein said gas is brought into contact with the recycled liquid phase further containing at least one anti-corrosion additive which is a normally liquid non-hydrocarbon compound other than water, said compound being dispersable in water, in which it is separated from the aqueous phase issuing from step (a) by a complementary separation step under suitable separation conditions and re-mixed with the gaseous phase issuing from step (a).

5. A process according to claim 3 or claim 4 wherein the proportions by weight in the recycled liquid phase are as follows:

from 0.1 to 5% of anti-corrosion additive,
from 10 to 70% of anti-hydrate additive, and
from 29.9 to 89.9% of water.

6. a process according to claim 3 wherein the anti-corrosion additive is diethylamine, propylamine, butylamine, triethylamine, dipropylamine, ethylpropylamine, ethanolamine, cyclohexylamine, pyrridic morpholine or ethylenediamine.

7. A process according to claim 1 wherein, in step (a), the proportion of recycled liquid phase with respect to the flow rate by mass of the gas issuing from the well is from 0.05 to 5% by weight and preferably from 0.1 to 1% the temperature being substantially between 20 and 100° C. and the pressure being from 0.1 to 25 MPa.

8. a process according to claim 1 wherein in the course of step (c), the condensate comprises an aqueous phase and a liquid hydrocarbon phase, the hydrocarbon phase being separated from the aqueous phase by settlement in the course of step (d) and discharged.

9. a process according to claim 1 wherein the gas issuing from the production well is divided into at least two fractions, a first fraction A of said gas being subjected to step (a) and a second fraction B which is not subjected to step (a) being mixed with the gaseous phase issuing from step (a).

10. A process according to claim 1 wherein said production gas is produced by at least two different wells and that step (a) is carried out in at least two distinct contact zones and that the gaseous phases issuing from said contact zones are mixed before being subjected to step (b).

11. A process according to claim 1 wherein the anti-hydrate additive is methanol. methylpropylether, ethylpropylether, dipropylether, methyltertiobutylether, dimethoxymethane, dimethoxyethane, ethanol, methoxyethanol, or propanol.

12. A process according to claim 1 wherein the refrigeration temperature in step (c) is between +10 and −60° C.

13. A process according to claim 1 wherein the gas issuing from the production well contains a hydrocarbon condensate which is separated in a separation zone prior to proceeding to step (a) and the gaseous phase resulting from said separation operation is passed into the contact zone.

14. A process according to claim 13 wherein the hydrocarbon condensate and the gaseous phase issuing from step (a) are re-mixed before proceeding with step (b) and step (b) is effected in a diphasic mode.

15. A process according to claim 1 wherein step (a) is effected under the sea, the gas being transported in the course of step (b) by an underwater conduit.

16. A process according to claim 1 wherein gas issusing from step (d) is subjected to a complementary treatment by cold washing be means of a solvent used as an additive in the course of step (a) in order to eliminate at least a part of the acid gases contained in said gas.

17. An apparatus for transporting and treating a natural gas comprising in combination:

at least one enclosure (G1) for contacting under pressure and optionally in counter-flow relationship a gas with at least one additive, having a first end and a second end, means (1) for the introduction of said gas, which are connected to transportation means (3, 5) and/or to the second end of the enclosure, means (4) for the introduction of an aqueous liquid phase comprising at least one additive, connected to means for recycling of said liquid phase and to the first end of said enclosure, means (2) for the discharge of a liquid aqueous phase, connected to the second end of the enclosure, means (3, 5) for transportation of a gaseous phase under pressure, connected to the first end of the enclosure (G1) and to means ($E_1$) for heat exchange under pressure, means ($B_1$) for separation of a liquid aqueous phase from the non-condensed treated gas, which are connected to the heat exchange means, means (10) for recovery of the non-condensed and treated gas, which are connected to the separation means ($B_1$), means (8) for taking off the aqueous phase, which are connected to the separation means; and means ($P_1$, 9, 4) for recycling of the aqueous phase, which are connected to the means for taking off the aqueous phase, comprising a conduit connected to the first end of the enclosure (G1).

18. An apparatus according to claim 17 comprising means for separation of the natural gas with condensates which are connected to the means (1) for introducing the gas comprising a first outlet (30) for discharge of an aqueous phase, a second outlet (31) for discharge of the gas to be treated, which is connected to the second end of the enclosure (G1), and a third outlet for a hydrocarbons condensate which is connected either to the transportation means (3, 5) or to a reception terminal or to the transportation means (3, 5) and to the terminal.

19. An apparatus according to claim 17 comprising a complementary separator (S1) for water and additive, which is connected to the means (2) for discharge of the liquid aqueous phase, comprising an outlet (40) for discharge of water and an outlet (41, 42) for taking off additive, which is connected to the transportation means (3, 5).

20. An apparatus according to claim 17 comprising additive make-up means (11) which are connected to the recycling means ($P_1$, 9, 4).

21. An apparatus according to claim 17 comprising means for washing the treated gas, which are connected to the separation means ($B_1$).

* * * * *